United States Patent [19]

Hetrick

[11] 4,261,520

[45] Apr. 14, 1981

[54] HOPPER DEVICE FOR MATERIAL SPREADER HAVING A MULTI-POSITIONABLE COVER

[75] Inventor: Vernon L. Hetrick, North Olmsted, Ohio

[73] Assignee: Meyer Products, Inc., Cleveland, Ohio

[21] Appl. No.: 93,132

[22] Filed: Nov. 9, 1979

[51] Int. Cl.[3] ..... E01C 19/20

[52] U.S. Cl. ..... 239/657; 222/413; 222/626; 414/489

[58] Field of Search ..... 239/657, 675, 676; 414/489, 526; 222/148, 328, 413, 609, 626, 181

[56] References Cited

U.S. PATENT DOCUMENTS

| | | | |
|---|---|---|---|
| 3,189,355 | 6/1965 | Swenson et al. | 239/675 X |
| 3,349,970 | 10/1967 | Daneman | 222/413 X |
| 3,438,585 | 4/1969 | Buchmann | 239/676 X |
| 3,510,066 | 5/1970 | Swenson | 239/657 |
| 4,157,150 | 6/1979 | Hetrick | 414/526 X |

*Primary Examiner*—Andres Kashnikow

*Attorney, Agent, or Firm*—Meyer, Tilberry & Body

[57] ABSTRACT

A device for spreading particulate material from a vehicle mounted dump bed includes a hopper device mounted transversely across a material discharge end of the dump bed and a broadcast spreader beneath one end of the hopper device. The hopper device includes first and second spaced end walls, a fixed back wall between the end walls, and an elongated auger extending between the end walls arranged to be rotated about an axis parallel to the back wall. Rotation of the auger causes particulate material entering the hopper device to be moved toward one end wall beneath which the broadcast spreader is located. Spreading through, dumping over, and cleaning of the hopper device are possible as a result of an independent cover member extending between the end walls and movable between three corresponding positions. Support of the cover member relative to the hopper device is provided by a series of latching pins through each of the end walls and into portions of the cover member with one pin connection allowing movement of the cover member into a generally upstanding position for cleaning of the hopper device.

15 Claims, 7 Drawing Figures

HOPPER DEVICE FOR MATERIAL SPREADER HAVING A MULTI-POSITIONABLE COVER

BACKGROUND OF THE INVENTION

This invention relates to the art of spreading materials such as salt, cinders or gravel, on roadways and, more particularly, to an improved hopper for use on a vehicle employed in spreading material on a roadway. While the invention is particularly applicable for use on a vehicle for spreading salt on a roadway during the winter season and will be described with particular reference thereto, it is appreciated that the invention has broader applications and can be used for vehicles spreading various materials along the roadway or path being traveled by the vehicle.

During the winter season, it has become common practice to spread salt or cinders along a roadway to remove ice and reduce the tendency for skidding of motor vehicles traveling along the roadway. While many arrangements for spreading salt or cinders have been attempted, the most accepted devices include a broadcast spreader having a rotating disc which centrifugally discharges salt or cinders dropped on the spreader from a dump bed carried by the vehicle as the vehicle moves along the roadway. Since the broadcast spreader generally has a width substantially less than the width of the dump bed of the vehicle, provisions must be made for channelling the salt or cinders falling from the dump bed to an area immediately above the broadcast spreader. A hopper device extending along a discharge end of the dump bed is customarily used to channel the particulate material onto the spreader. These hoppers generally include spaced end walls, a backwall positioned adjacent to and directly beneath the discharge end of the dump bed, and a front wall deflecting the particulate material into the hopper. A rotating auger is provided near the bottom of the hopper for the purpose of moving the particulate material to a discharge opening in the bottom of the hopper from which the salt or cinders drop onto the broadcast spreader. While the discharge opening may be located at any position along the hopper, generally the opening is located at the end of the hopper nearest the center of the roadway being traveled. As a result of the location of the discharge opening, the rotating auger is required to move portions of the particulate material the entire length of the hopper toward the end wall nearest the roadway center. This combination of hopper, rotating auger and broadcast spreader is widely used in spreading salt or cinders along roadways.

While the hopper and broadcast spreader combination is beneficial during use as a spreader, even an occasional necessity of dumping particulate material directly onto the roadway presents problems. In this regard, if a larger quantity of material or a wide path of material were desired to be deposited on the roadway, the hopper device would have to be removed from the vehicle. To overcome this difficulty, it has been proposed that the hopper include a movable cover plate having a first position for spreading and a second position for dumping. A device having such a movable cover plate is shown in Swenson, U.S. Pat. No. 3,189,355. This reference teaches of a cover plate movable into a vertical position for spreading in which position the cover plate provides a backing plate for directing particulate material into a hopper. Moving the cover plate to a horizontal position allows dumping of particulate material over the hopper. This concept of providing a cover having spreading and dumping positions is a commonly utilized design as shown by Daneman, U.S. Pat. No. 3,349,970 and Buchmann U.S. Pat. No. 3,438,585.

Another problem which commonly occurs in salt or cinder spreaders having hopper devices and rotating augers is clogging of the salt or cinders within the hopper surrounding the auger. In the spreader devices discussed above, the hopper has an inlet through which the particulate material enters from the dump bed and a relatively small discharge opening through which the material falls onto the spreader. Salt or cinders being spread often clog the auger, especially if it becomes damp or is allowed to sit for a prolonged time in the hopper. The design of the hopper as an enclosed device results in considerable effort being expended to unclog the hopper and auger. As a solution to this problem it has been proposed that the hopper be provided with an arrangement allowing access to the auger for cleaning. Such an arrangement is shown in a Swenson, U.S. Pat. No. 3,510,066. A lower portion of a hopper is pivotally mounted at a bottom edge to enable the portion to be dropped for cleaning of the hopper and access to the auger. The pivoting lower portion extends the entire longitudinal length of the hopper. This reference requires a first movable panel for dumping and spreading and a second movable panel for clean-out of the hopper.

An improvement upon this immediately above noted concept is shown in Hetrick, U.S. Pat. No. 4,157,150 wherein spreading, dumping and cleaning are provided by a single positionable panel of a hopper device. The panel is permanently secured to the hopper by links pivotally mounted on a pair of spaced sidewalls and the sides of the panel resulting in the panel being movable relative to the hopper through spreading, dumping and cleaning positions. Locking pins are appropriately positioned through a series of apertures in each of the sidewalls. Corresponding apertures in the panel provide releasable locking of the panel by the pins in the spreading and dumping positions.

SUMMARY OF THE INVENTION

The present invention relates to an improvement in a hopper mounted at a discharge end of a dump body of a vehicle employed in spreading particulate material onto a roadway upon which the vehicle travels wherein an independent cover member is movable between three positions allowing dumping, spreading and cleaning of particulate material from the hopper. Rigid locking of the cover member is possible in at least the dumping and spreading positions as a result of removable pins and apertures providing a sturdy structure during these two operating and weight absorbing positions. The cover member is not permanently attached to the hopper.

In accordance with the present invention, there is provided a hopper of the type described above which includes a cover member formed from a generally flat plate extending between two spaced end walls with an integral portion extending angularly from the flat plate and generally co-extensive therewith. The cover member is secured to the hopper only by removable pins extending through apertures in each end wall and into openings in the cover member. When only one removable pin at each end of the cover member is releasably inserted through the end walls and into the cover member, the cover member may be pivoted about the pins. The removable pins are the only support provided for the cover member, therefore at least one pin must engage the cover at each end wall at all times. As a direct result of mounting the cover member to the hopper only with removable pins rather than permanent structures, the construction and operation of the device is simplified. While the elimination of a component obviously benefits the cost of the device, the particular circumstances of the instant device further benefit the ease of operation by avoiding limitations of movement of the cover relative to the hopper characteristic of permanent structures.

A first positioning combination of two removable pins provides secure latching of the cover member in a first position corresponding to spreading. In this first position, the flat plate defines a front wall for the hopper and the closure portion closes the hopper below the auger. The closure portion includes a material discharge opening through which the material exits the hopper onto a broadcast spreader. Different positioning of two removable pins secures the cover member in a second position corresponding to dumping, with the flat plate extending over the auger from the discharge end of the dump body to allow dumping of material over the hopper and onto the roadway traversed by the vehicle. Finally, use of only one of the removable pins pivotally secures the cover member to the hopper. With the cover member pivoted upward and into abutment with the vehicle dump body, a transverse opening exposes the entire length of the hopper and auger for cleaning or other servicing. The removable pin allowing the cover member to pivot to the cleaning position is also used for the spreading position. In this respect, by removing one pin, an operator can move the cover directly from the spreading position to the dumping position.

The primary object of the present invention is the provision of a hopper device of the type carried by a vehicle for use in spreading particulate material from a dump bed mounted on the vehicle onto a roadway on which the vehicle travels, which hopper device can be easily connected to standard vehicles, is somewhat inexpensive to produce, and can be easily maintained.

Another object of the present invention is the provision of a hopper device to be carried by a vehicle for use in spreading particulate material from a dump bed onto a roadway in which a single releasably mounted cover member is selectively movable between spreading, dumping and cleaning positions.

Still a further object of the present invention is the provision of a hopper device carried by a vehicle for use in spreading particulate material from a dump bed of the vehicle onto a roadway in which cleaning access is provided to the entire inside of the hopper including an auger rotatably mounted within the hopper.

Another object of the present invention is the provision of a hopper device carried by a vehicle for use in spreading particulate material from a dump bed of the vehicle onto a roadway in which a releasably mounted movable cover member is supported only by removable pins through both end walls of the hopper to control manual movement of the cover member between spreading, dumping and cleaning positions.

BRIEF DESCRIPTION OF THE DRAWINGS

The invention may take physical form in a variety of parts and arrangements of parts, preferred embodiments of which will be described in the following specification and are illustrated in the accompanying drawings which form a part hereof and wherein.

DETAILED DESCRIPTION OF THE PREFERRED EMBODIMENTS

Figure 1:
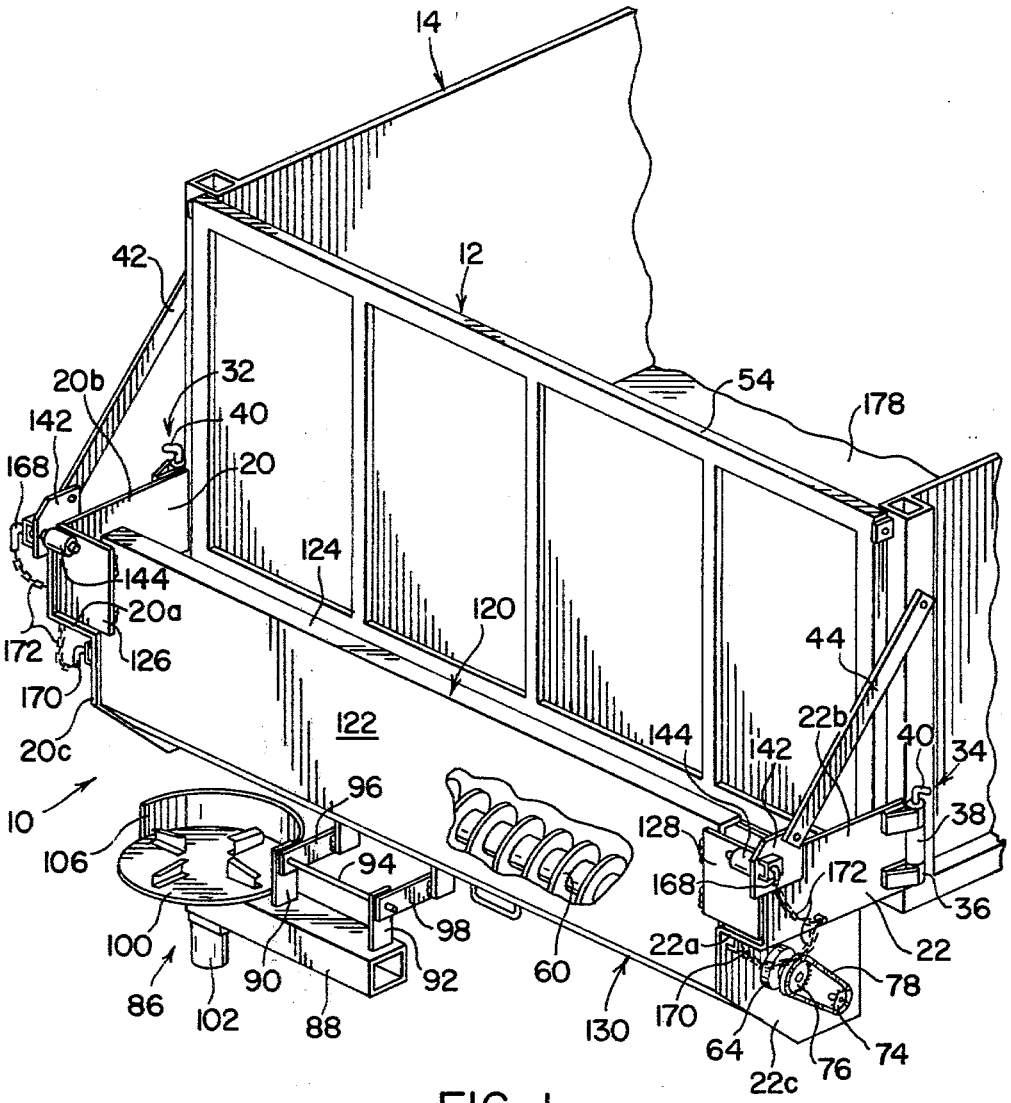
FIG. 1 is a pictorial view illustrating the preferred embodiment of the invention and its connection onto the rear of a partially illustrated dump bed of a vehicle.

Referring now to the drawings wherein the showings are for the purpose of illustrating the preferred embodiments of the invention only and not for the purpose of limiting the same, FIG. 1 shows a hopper 10 constructed in accordance with the present invention and secured onto a material discharge end 12 of a dump body 14 attached to a vehicle, such as a truck, adapted to ride along a roadway and spread or dump material onto the roadway. As best seen in FIGS. 1–5, hopper 10 includes a relatively rigid fixed structure having spaced generally vertical end plates 20 and 22 between which there is fixedly secured a back plate 24. End plates 20 and 22 include generally horizontal portions **20*a* and 22*a*, respectively, corresponding upper vertical portions 20*b* and 22*b*, and corresponding lower vertical portions 20*c* and 22*c*. Back plate 24 is aligned with and extends downward from horizontal portions 20*a* and 20*b*. The back plate includes a vertical wall 26, a forwardly angled wall 28 and a rearwardly bent deflector wall 30 preferably formed from a single sheet of metal. To mount hopper 10 onto dump body 14, pin connectors 32 and 34 are provided at the rear edge of each upper vertical portion of end plates 20 and 22, respectively, shown in FIG. 1. Pin connectors 32 and 34 each include a pair of hopper mounted sleeves 36 and a bed mounted sleeve 38 which, once aligned, are connected by an L-shaped pin 40 extending through the sleeves to secure hopper 10 onto dump body 14. Additional support of hopper 10 is provided by struts 42 and 44 extending from dump body 14 to end plates 20 and 22**, respectively.

Figure 3:
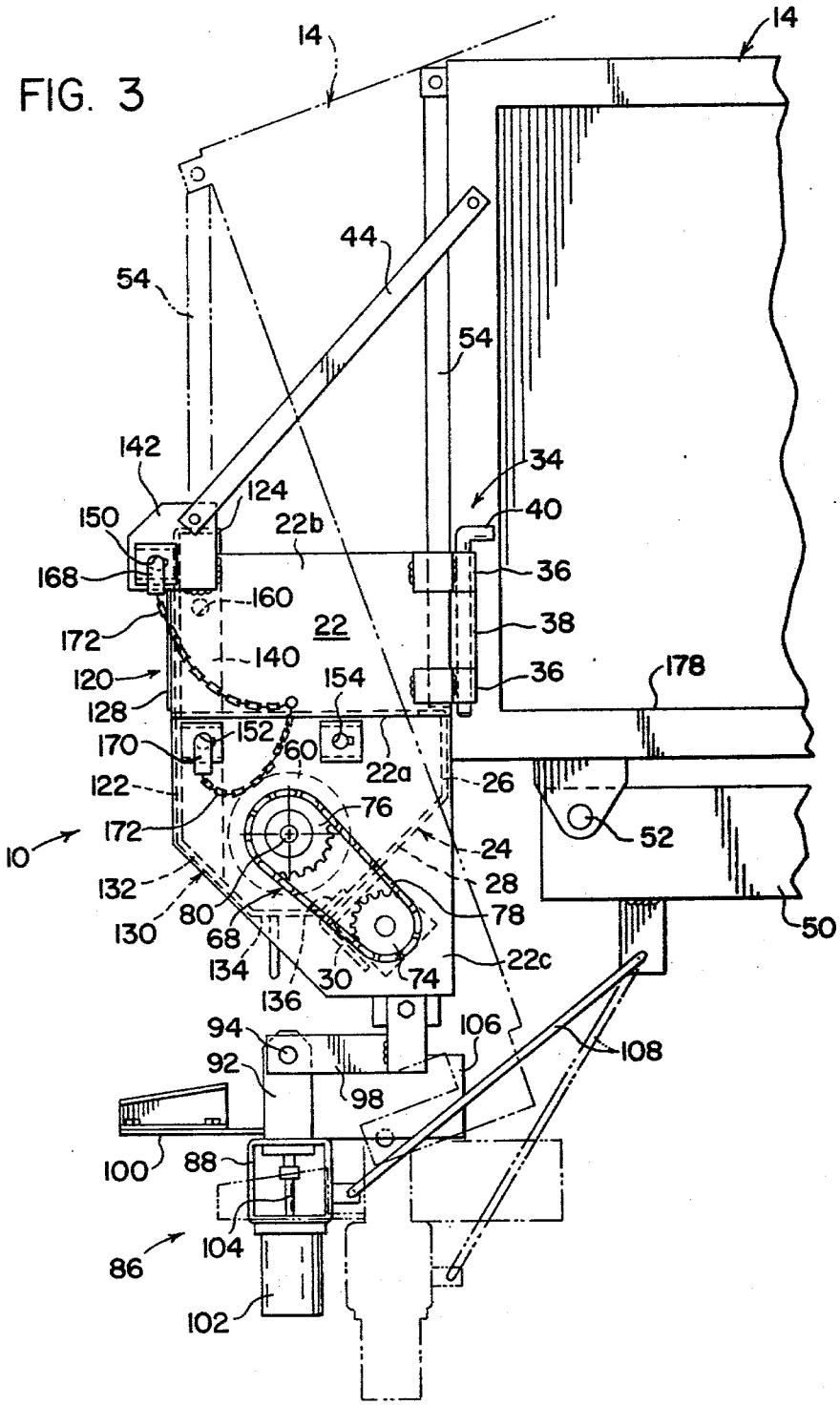
FIG. 3 is a side view of the preferred embodiment of the invention as illustrated in FIGS. 1 and 2 and showing in phantom lines a tilting position of a hopper device as the vehicle bed is tilted to discharge material into the hopper.
Figure 4:
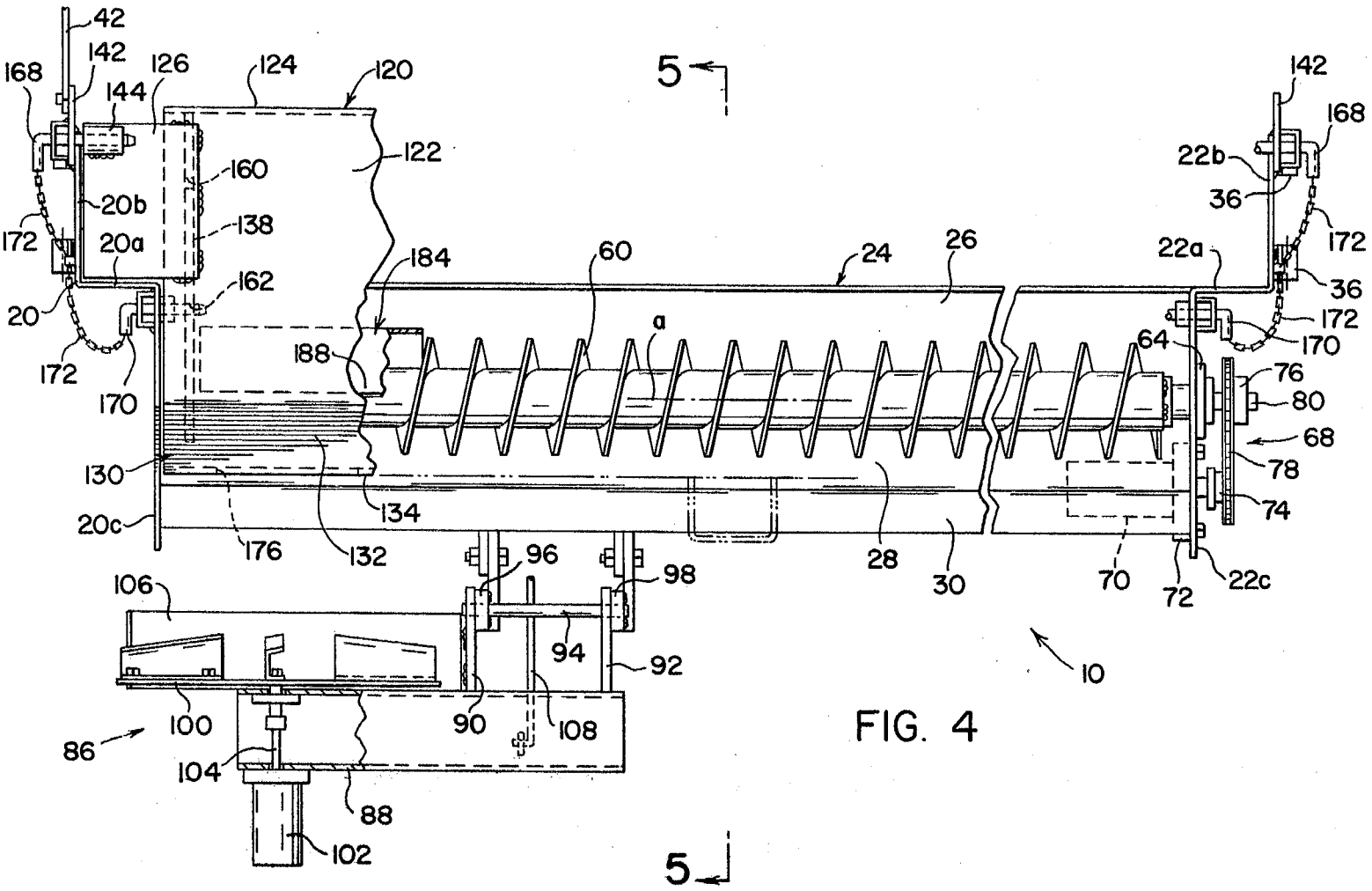
FIG. 4 is a front elevation view generally similar to FIGS. 2 and 3.

As best shown in FIG. 3, dump body 14 may be pivoted relative to a generally fixed vehicle frame 50 about a pivot trunnion 52. Upon pivotal movement of the dump body, a tailgate 54 pivots about its upper edge to allow material from dump body 14 to fall into or over hopper 10 in accordance with what is considered standard practice. As the dump body is pivoted about trunnion 52, hopper 10 is tilted into the phantom line position shown in FIG. 3 to accept material from the dump body 14.

Referring now more particularly to FIGS. 1-4, an auger 60 is supported between end plates 20 and 22 by journals 62 and 64, respectively. Auger 60 rotates about an axis "a" to drive material along the hopper bottom from right to left, when the hopper is being used for spreading material. Any appropriate mechanism may be used to rotate the auger; however, a preferred embodiment includes a drive mechanism 68 with a motor 70 secured onto end plate 22 by a mounting plate 72. Motor 70 drives a sprocket 74 drivingly connected to a sprocket 76 by an interconnecting sprocket chain 78. Sprocket 76 is fixedly mounted on a shaft 80 which is in turn connected to auger 60 to rotate the auger in a manner similar to standard hoppers used for spreading particulate material on roadways. A broadcast spreader 86 is located beneath the left end of hopper 10, as viewed in FIG. 1. Broadcast spreader 86 includes a frame 88 which is supported on rigid arms 90 and 92 by a pivot shaft 94 which is in turn supported by rocker brackets 96 and 98 permanently secured to back plate 24. A spreader wheel 100 is rotatably supported on frame 88 and is controllably rotated by a motor 102 through a shaft 104 (FIG. 3) for spreading material dropped onto the wheel from hopper 10. Extending circumferentially around a portion of spreader wheel 100 is a rearward facing rim 106 to prevent discharge of material toward dump body 14. Rearward facing rim 106 is permanently fixed relative to frame 88. A stabilizer 108 maintains broadcast spreader 86 in a generally vertical position as dump body 14 is tilted in a manner illustrated in FIG. 3.

As so far described, this structure does not differ substantially from known arrangements for spreading salt or other particulate material onto a roadway being traversed by a vehicle carrying dump body 14. In accordance with known practices in the art, hopper 10 is provided with an arrangement for allowing spreading by broadcast spreader 86, dumping over the hopper onto the roadway from dump body 14 and cleaning of auger 60. The present invention relates to an arrangement for accomplishing this selective conversion of the hopper 10 in a more efficient and structurally rigid manner.

Figure 5:
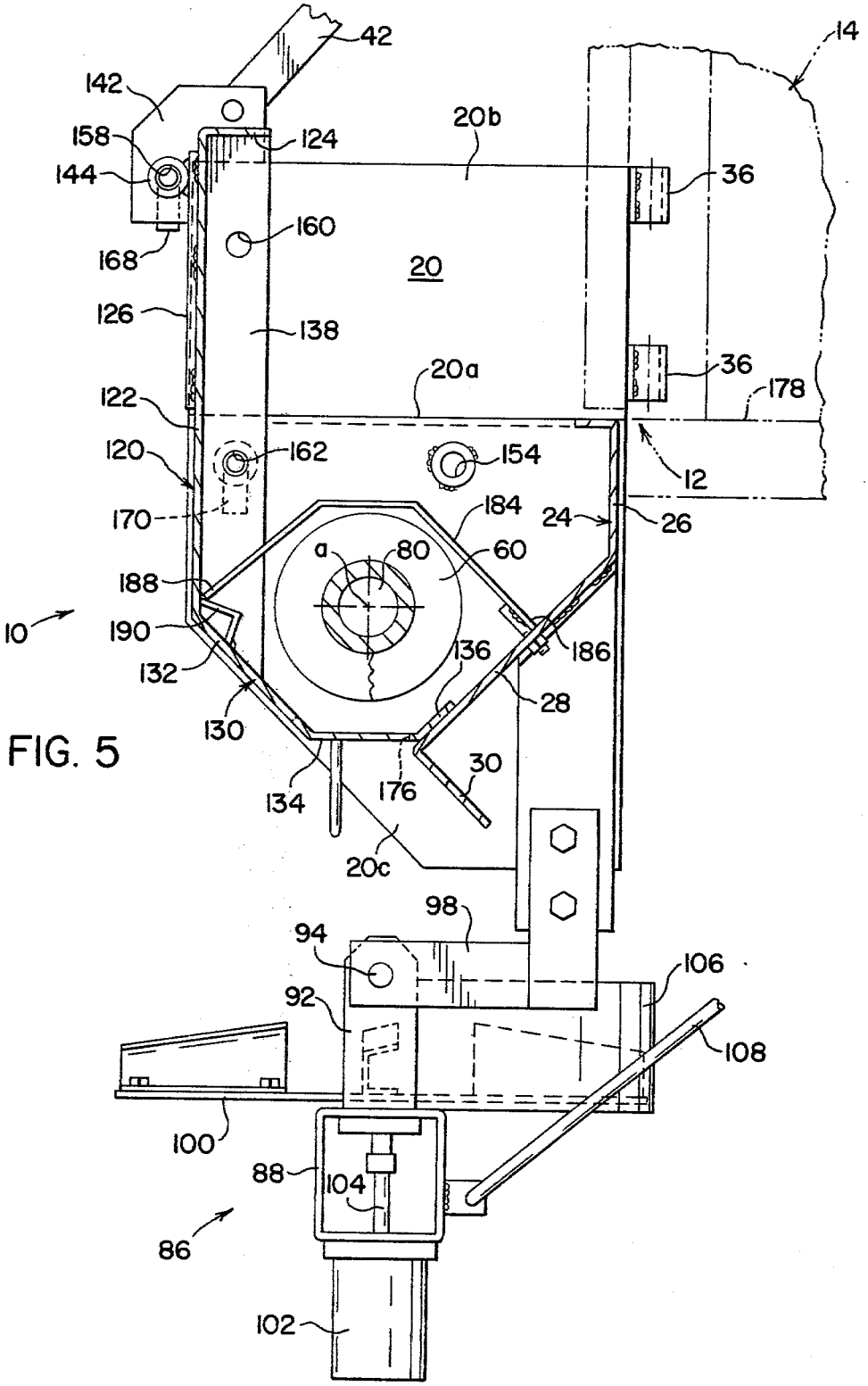
FIG. 5 is a cross-sectional view taken generally along line 5—5 of FIG. 4 and showing the hopper with the cover member in a spreading position as also shown in FIGS. 1–4.

In accordance with the present invention, a completely independent cover member 120 for hopper 10 is provided which enables spreading of particulate material through the hopper, dumping of particulate material over the hopper and cleaning of the hopper and auger subject only to simple repositioning of the cover. As shown in FIG. 5, cover member 120 includes an upper wall portion 122 having an upper end flange 124 extending inwardly therefrom. Cover member 120 has a width equal to the distance between lower portions 20*c* and 22*c* of end plates 20 and 22. As best illustrated in FIG. 1, upper wall portion 122 is provided with outwardly extending plates 126 and 128 adapted to extend along the horizontal portions 20*a* and 22*a* of end plates 20 and 22. Plates 126 and 128 carry the weight of upper wall portion 122 when it is in the spreading position, and also prevent material from discharging around the ends of the upper wall portion.

Figure 2:
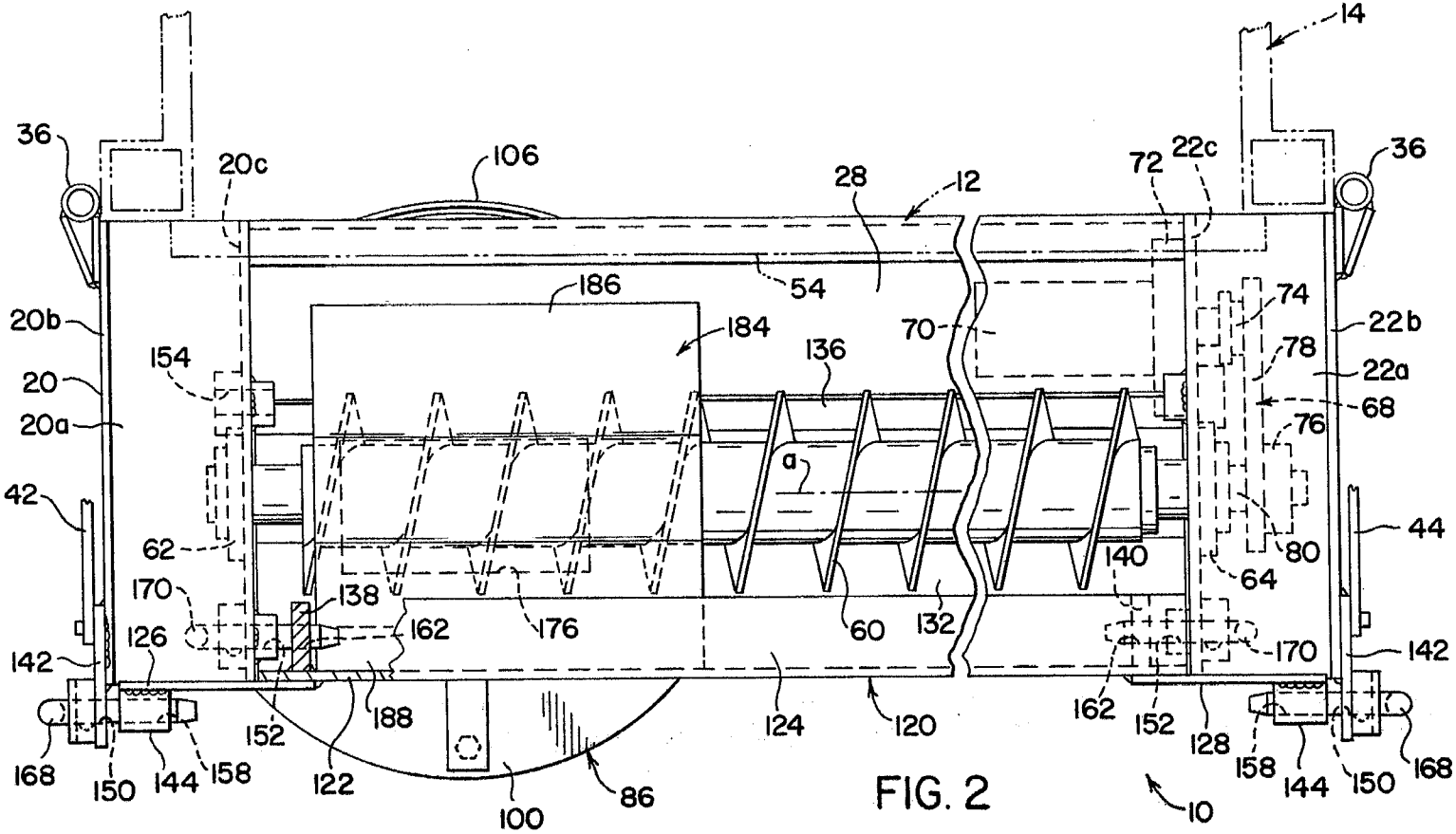
FIG. 2 is a top elevation view, with a cut away portion to show both end structures, and illustrating the preferred embodiment of the present invention.

FIG. 5 shows a closure wall portion 130 formed integrally with upper wall portion 122 and angling away from upper flange 124 to form a lower portion of the hopper chamber when cover member 120 is in the spreading position. Closure portion 130 has a sloped portion 132 terminating in a bottom portion 134 which includes an outwardly extending stop 136. When cover member 120 is in the spreading position, shown in FIG. 5, stop 136 of the closure portion rests against angled wall 28 of back plate 24 to both locate and support closure portion 130. At the left and right ends of cover member 120, as shown in FIG. 2, transverse beams 138 and 140 are permanently secured to the cover member and extend therealong from upper flange 124 to sloped portion 132. These transverse beams provide added rigidity to cover member 120 and also aid in positioning the cover member in the spreading, dumping and cleaning positions, as set forth hereinafter. Extending outwardly from an upper corner of each end plate 20 and 22 is a permanently attached bracket plate 142, and corresponding pin receiving sleeves 144 are attached to upper wall 122 of the cover member adjacent each plate 142.

Plates 142 are provided with horizontally aligned apertures 150, and end plates 20 and 22 are provided with horizontally aligned pairs of apertures 152 and 154. Apertures 150, 152 and 154 are located relative to end plates 20 and 22 such that apertures 150 and 152 are generally vertically aligned, with aperture 150 being above aperture 152. Apertures 152 and 154 are horizontally aligned, with aperture 154 nearest back plate 24 of the hopper. Additionally, the distance separating apertures 150 and 152 is greater than the distance separating apertures 152 and 154. Pin receiving sleeves 144 provide the ends of cover member 120 with horizontally aligned apertures 158, and transverse beams 138 and 140 on the cover member are provided with horizontally aligned pairs of apertures 160 and 162. Apertures 158, 160 and 162 are generally vertically aligned when cover member 120 is in the spreading position. More particularly, aperture 160 is directly above aperture 162, while aperture 158 is above both apertures 160 and 162 and slightly more separated from back plate 24. The distance between apertures 158 and 162 is precisely equal to the distance between apertures 150 and 152 as noted above. Furthermore, the distance between apertures 160 and 162 is precisely equal to the distance between apertures 152 and 154, noted above. The apertures are utilized to releasably position cover member 120 relative to hopper 10 in the three operable positions as will be more fully explained hereinafter.

FIG. 5 illustrates cover member 120 of hopper 10 releasably mounted on the hopper and positioned for spreading of particulate material by means of auger 60 within the hopper. With cover member 120 as shown in FIG. 5, apertures 150 through plates 142 are each aligned with aperture 158 in the corresponding pin receiving sleeve 144, and apertures 152 in end plates 20 and 22 are each aligned with the aperture 162 in the corresponding one of the beams 138 and 140. A first removable pin 168 is inserted at each end of the hopper through aligned apertures 150 and 158, and second removable pins 170 are inserted through aligned apertures 152 and 162. Once first and second removable pins 168 and 170 are inserted through end plates 20 and 22 into the cover member, sufficient support is provided for cover member 120 to withstand stresses and forces exerted during the spreading operation. In this position, upper wall 122 of the cover member provides a backstop for particulate material falling from dump body 14 into hopper 10. Closure portion 130 restrains the particulate material at the bottom of the hopper while auger 60 moves the material along the hopper, to the left as viewed in FIGS. 1 and 2. Since at least one of first and second removable pins 168 and 170 are involved in positioning cover member 120 in each of the three operable positions, the pins are preferably permanently attached to hopper 10 by any convenient means such as, for example, chains 172 as shown in FIG. 1. Stop portion 136 of the closure portion rests against angled wall 28 of back plate 24. A discharge opening 176, best shown in FIG. 2, is provided directly above the central portion of spreader wheel 100 of the broadcast spreader. As auger 60 is rotated by motor 102, material from dump bed 14 is moved toward discharge opening 176 and is discharged onto the rotating spreader wheel. As can be seen in FIG. 5, stop portion 136 and first and second removable pins 168 and 170 cooperatively secure cover member 120 in the spreading position for discharge of material through hopper 10 onto broadcast spreader 86.

Figure 6:
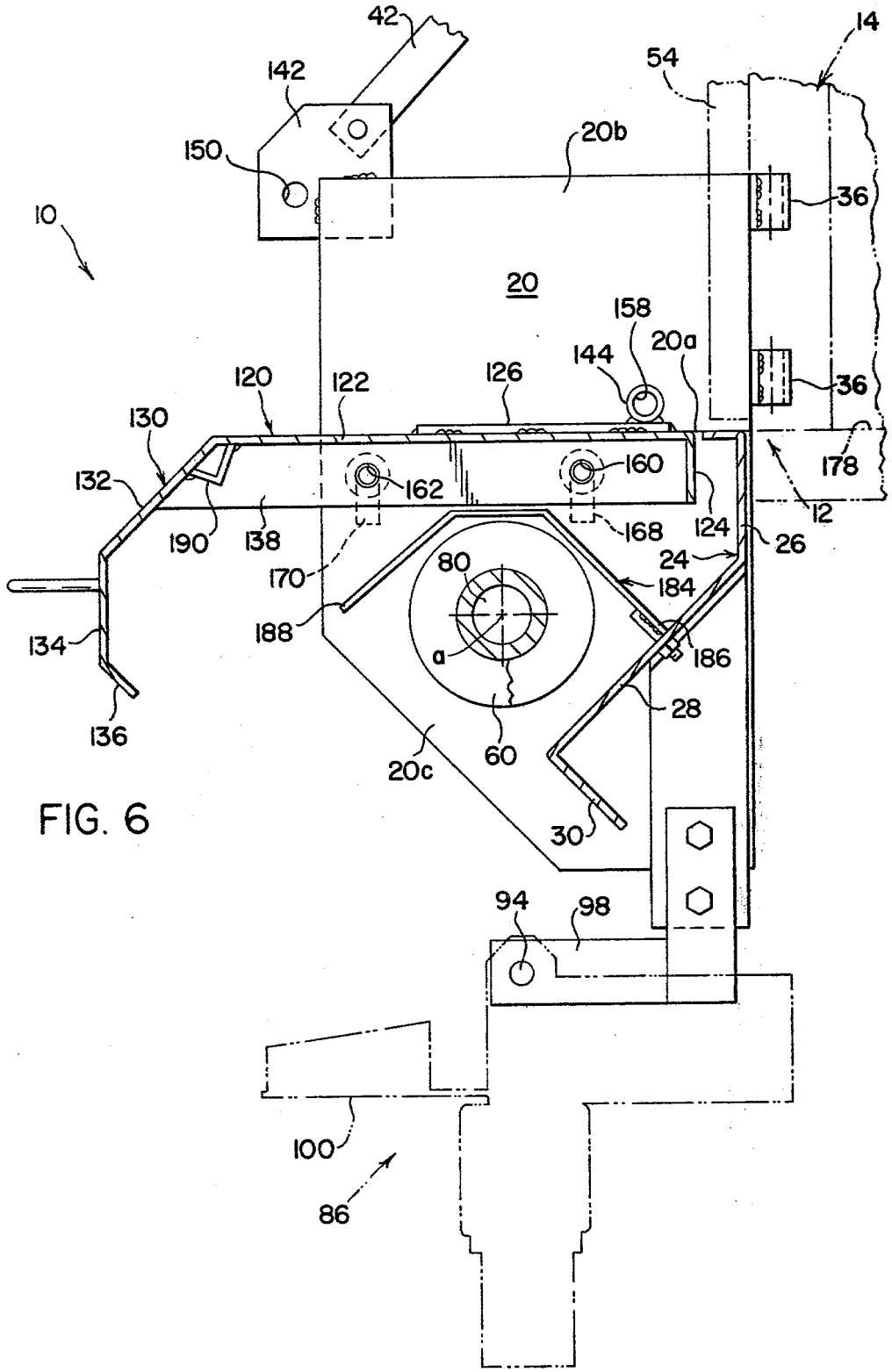
FIG. 6 is a view similar to FIG. 5 showing the cover member in a dumping position; and, FIG. 7 is a view similar to FIG. 5 showing the cover member in a cleaning position.

Referring now to FIG. 6, cover member 120 is shown in the dumping position which allows discharge of particulate material from dump body 14 over the upper flange of upper wall portion 122. In this respect, upper wall portion 122 is generally aligned with floor 178 of dump body 14. To move cover member 120 to the dumping position, first removable pins 168 are withdrawn from apertures 150 and 158, and cover member 120 is pivoted about second removable pins 170 from the position shown in FIG. 5 to that shown in FIG. 6. In the latter position, apertures 160 in beams 138 and 140 are aligned with apertures 154 in end plates 20 and 22, and first removable pins 168 are reinserted through these aligned apertures to secure cover member 120 in the dumping position. In this position, laterally outwardly extending plates 126 and 128 overlie and engage portions 20*a* and 22*a* of the end plates to provide additional support for cover member 120. It will be appreciated, therefore, that first and second removable pins 168 and 170 and outwardly extending plates 126 and 128, cooperatively rigidify support of the cover member in the dumping position as shown in FIG. 6.

Figure 7:
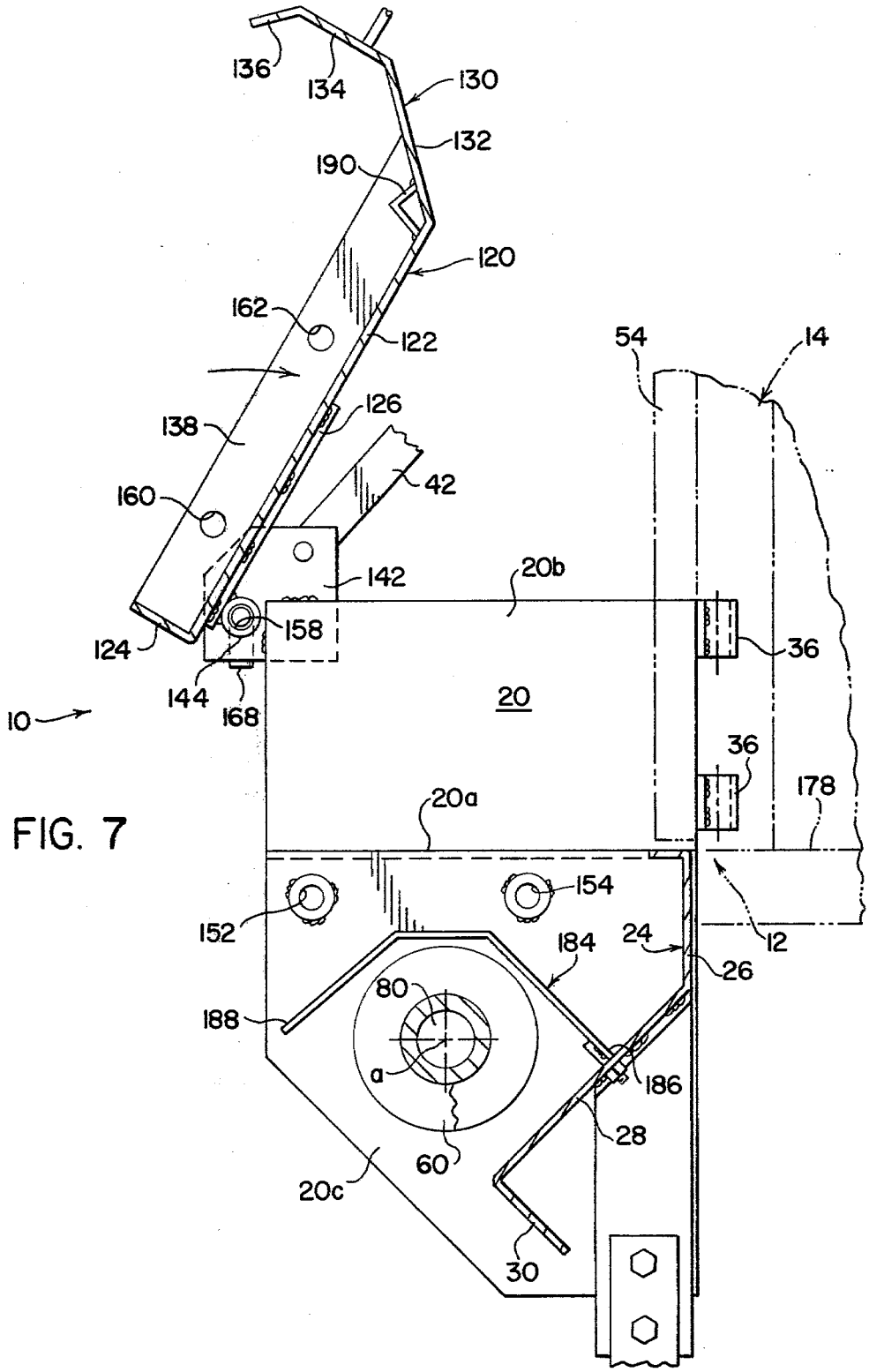

In order to move cover member 120 to the cleaning position, as shown in FIG. 7, from the dumping position shown in FIG. 6, first removable pins 168 are withdrawn and cover member 120 is pivoted about second removable pins 170 and returned to the spreading position as shown in FIG. 5. First removable pins 168 are then reinserted through aligned apertures 150 and 158. Second removable pins 170 and then withdrawn from aligned apertures 152 and 162, and the cover member is pivoted about first removable pins 168 from the position shown in FIG. 5 to that shown in FIG. 7. Cover member 120 is pivoted upward and toward dump body 14 until contact is made between the cover member and tail gate 54. The cover member may be moved directly to the cleaning position from the spreading position by withdrawal of second removable pins 170 from aligned apertures 152 and 162. Cover member 120 is then pivoted about first removable pins 168 as explained above.

The angle of the cover member relative to hopper 10 once in the cleaning position provides an over-center status and is sufficient to maintain the cover in the position until positive movement by an operator downward and out of the cleaning position occurs. It should be understood that a physical stop may be used to maintain cover member 120 in the cleaning position if desired. Such a physical stop may comprise a flexible link, such as a chain, restraining pivoting movement toward tail gate 54 beyond a predetermined position. The physical stop might also consist of a solid stop, such as a bar affixed to end plates 20 or 22 or strut 42 or 44. In this cleaning position, the entire hopper interior including auger 60 is exposed for cleaning by appropriate devices such as a water hose or manual scrapper. Since the lower portion of hopper 10 is open, water can drain from the auger cleaning operation, and hopper back plate 24 is exposed for cleaning.

It is important to note that first and second removable pins 168 and 170 provide the only interconnection between cover member 120 and hopper 10. In this regard, at least one set of the first and second removable pins must remain in place between the cover member and hopper to maintain the cover member thereon. At the same time, it will be appreciated that removal of both sets of pins advantageously enables complete removal of cover member 120 if desired.

In order to prevent direct discharge of the particulate material through discharge opening 176 from dump body 14 during a spreading operation, an auger cover plate 184 is provided immediately over auger 60 and over the discharge opening, as best shown in FIGS. 2 and 5. Auger cover plate 184 extends axially parallel to auger 60 the full length of discharge opening 176 and has a first edge 186 permanently secured to angled wall 28 of back plate 24. A second edge 188 of the auger cover plate rests on a support bracket 190, mounted on cover member 120, when the cover member is in the spreading position as shown in FIG. 5. The contour of bracket 190, and the location thereof on cover member 120, enables the latter to freely pivot to the dumping and cleaning positions shown in FIGS. 6 and 7 without interference from the auger cover. The auger cover, of course, does not require support along second edge 188 thereof other than when cover member 120 is in the spreading position and particulate material in dump body 14 falls onto the auger cover, and bracket 190 provides the necessary support for the auger cover during a spreading operation. It will be appreciated of course that auger 60 feeds particulate material along bottom portion 134 of hopper 10, under auger cover plate 184 and through discharge opening 176 onto broadcast spreader 86.

While considerable emphasis has been placed herein on preferred embodiments of the invention, and the specific structures and structural interrelationships of the component parts thereof, it will be readily apparent that many embodiments of the invention can be made, and that many changes can be made in the embodiments herein illustrated and described without departing from the principles of the invention. Accordingly, it is to be distinctly understood that the foregoing descriptive matter is to be interpreted merely as illustrative of the invention and not as a limitation.

I claim:

1. In a hopper device adapted to be mounted transversely across the material discharge end of a vehicle to spread particulate material over a roadway being traveled by said vehicle, said hopper device having fixed first and second spaced end plates with upper portions, a fixed back wall connected between said end plates, an elongated auger extending between said end plates, means for rotating said auger about an axis generally parallel to said back wall for conveying said material toward said first end plate, the improvement comprising: an independent cover member having opposite edges and extending between said end plates, said cover member having a first wall normally forming a bottom of said hopper with a discharge opening and second wall generally perpendicular to said first wall, said second wall having an outboard edge; each edge of said cover member having a first receptacle adjacent said outboard edge and a second receptacle spaced from said first receptacle; each said end plate having first, second and third spaced apertures therethrough with said first aperture adjacent said upper portion; said cover member being releasably secured to said hopper in a spreading position with said first wall forming a front and said second wall forming a bottom of said hopper by a first mounting arrangement, in a dumping position forming a top of said hopper by a second mounting arrangement, and in a cleaning position exposing said auger by a third mounting arrangement; said first mounting arrangement including pin means extending through said first apertures into said first receptacles and through said second apertures into said second receptacles for fixedly and axially securing said cover member; said second mounting arrangement including pin means extending through said second apertures into said second receptacles and through said third apertures into said first receptacles for fixedly and axially securing said cover member; said third mounting arrangement including pin means extending only through said first apertures into said edges of said cover adjacent said first receptacles for pivotally and axially securing said cover member whereby said cover member is pivotally movable between a first position with said cover member depending downward from said outboard edge and a second position with said cover member extending upward above said end plates toward said back wall from said outboard edge.

2. The improvement according to claim 1 including an auger cover plate adjacent said first end plate and aligned with said discharge opening, said cover plate having a first edge secured to said back wall generally parallel to said auger axis and a second end extending over said auger, said cover member having a stop means engageable with said cover plate for holding said cover plate spaced above said auger when said cover member is in said spreading position.

3. The improvement according to claim 1 including stop means for limiting movement of said second wall of said cover member toward said back wall when said cover member is in said spreading position.

4. The improvement according to claim 1 including stop means for limiting movement of said cover member toward said back wall when said cover member is in said cleaning position.

5. The improvement according to claim 1 wherein said cover member moves over center when extending upwardly above said end plates toward said back wall into the cleaning position.

6. The improvement according to claim 1 wherein corresponding ones of said first, second and third apertures are horizontally aligned in said end plates.

7. The improvement according to claim 6 wherein corresponding ones of said first and second receptacles are horizontally aligned in the side edges of said cover member.

8. The improvement according to claim 1 including pin means extending through said second apertures into said second receptacles for pivotally axially securing said cover member whereby said cover member is pivotally movable between said spreading and dumping positions.

9. The improvement according to claim 1 wherein said third mounting means pivotally mounts said cover member for movement between said spreading and cleaning positions.

10. A method of releasably mounting an independent cover member to a hopper device adapted to be mounted transversely across the material discharge end of a vehicle to spread particulate material over a roadway being traveled by said vehicle, said hopper device having fixed first and second spaced end plates with upper portions, a fixed back wall connected between said end plates, an elongated auger extending between said end plates, means for rotating said auger about an axis generally parallel to said back wall for conveying said material toward said first end plate, said cover member extending between said end plates and having a first wall normally forming a bottom of said hopper with a discharge opening, a second wall generally perpendicular to said first wall with an outboard edge, and opposite edges, the method comprising the steps of: providing each edge of said cover member with a first receptacle adjacent said outboard edge and a second receptacle spaced from said first receptacle; providing each said end plate with first, second and third spaced apertures, said first aperture being adjacent said upper portion; releasably securing said cover member to said hopper in one of a spreading position with said first wall forming a front and said second wall forming a bottom of said hopper, a dumping position forming a top of said hopper, and a cleaning position exposing said auger and hopper; extending pin means through said first apertures into said first receptacles and through said second apertures into said second receptacles to fixedly axially secure said cover member in said spreading position; extending pin means through said second apertures into said second receptacles and through said third apertures into said first receptacles to fixedly axially secure said cover member in said dumping position; and, extending pin means only through said first apertures into said first receptacles to pivotally axially secure said cover member whereby said cover member is pivotally movable between a first position corresponding to said spreading position with said cover member depending downward from said outboard edge and a second position corresponding to said cleaning position with said cover member extending upward above said end plates toward said back wall from said outboard edge.

11. The method according to claim 10 including limiting the pivoting of said cover member upward above said end plates toward said back wall by a stop means.

12. The method according to claim 10 including moving said cover member over center when pivoted upward above said end plates toward said back wall.

13. The method according to claim 10 wherein providing said first and second receptacles in the edges of said cover member includes horizontally aligning corresponding ones of said first and second receptacles.

14. The method according to claim 13 wherein providing said first, second and third apertures in said end plates includes horizontally aligning corresponding ones of said first, second and third apertures.

15. The method according to claim 10 including extending pin means through said second apertures into said second receptacles to pivotally axially secure said cover member whereby said cover member is pivotally movable between said spreading and dumping positions.

* * * * *